US005565314A

United States Patent [19]

Nakatsu et al.

[11] Patent Number: 5,565,314

[45] Date of Patent: Oct. 15, 1996

[54] SILVER HALIDE PHOTOGRAPHIC LIGHT-SENSITIVE MATERIAL

[75] Inventors: Masaharu Nakatsu; Hiroshi Takehara, both of Minami-ashigara, Japan

[73] Assignee: Fuji Photo Film Co., Ltd., Kanagawa, Japan

[21] Appl. No.: 311,451

[22] Filed: Sep. 26, 1994

Related U.S. Application Data

[63] Continuation of Ser. No. 79,733, Jun. 22, 1993, abandoned.

[30] Foreign Application Priority Data

Jun. 30, 1992 [JP] Japan ..... 4-194614

[51] Int. Cl.$^6$ ..... G03C 1/035

[52] U.S. Cl. ..... 430/567; 430/570; 430/603; 430/605

[58] Field of Search ..... 430/567, 570, 430/603, 605

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 4,748,106 | 5/1988 | Hayashi | 430/567 |
| 5,206,153 | 4/1993 | Bando | 430/567 |

OTHER PUBLICATIONS

Research Disclosure 22534, Jan. 1983.

*Primary Examiner*—Lee C. Wright
*Attorney, Agent, or Firm*—Birch, Stewart, Kolasch & Birch, LLP

[57] ABSTRACT

In a silver halide emulsion, tabular silver halide grains substantially consisting of silver bromoiodide, each having faces as two parallel major faces, an aspect ratio of 2 or more, and an average silver iodide content of 1 mol % or more, account for 50% or more of a total projected area of silver halide grains.

13 Claims, No Drawings

SILVER HALIDE PHOTOGRAPHIC LIGHT-SENSITIVE MATERIAL

This application is a continuation of application Ser. No. 08/079,733 filed on Jun. 22, 1993, now abandoned.

BACKGROUND OF THE INVENTION

1. Field of the Invention

The present invention relates to a silver halide photographic light-sensitive material and, more particularly, to a silver halide emulsion with a high photographic sensitivity and a photographic light-sensitive material using the emulsion.

2. Description of the Related Art

Many silver halide emulsions for use in the manufacture of silver halide photographic light-sensitive materials contain silver halide compound crystals of a type consisting of two kinds of crystal faces: a (100) face and a (111) face.

According to the report by A. MIGNOT, E. FRANCOIS AND M. CATINAT, "CRISTAUX DE RBOMURE D' ARGENT PLATS, LIMITES PAR DES FACES (100) ET NON MACLES," Journal of Crystal Growth 123 (1974), pages 207 to 213, tabular silver bromide crystals having square or rectangular major faces and constituted by (100) faces were observed.

U.S. Pat. No. 4,063,951 discloses that tabular grains constituted by (100) crystal faces are formed from monodisperse seed grains, and, when ripened in the presence of ammonia, these tabular grains are formed to have an average aspect ratio ranging from 1.5 to 7. In addition, U.S. Pat. No. 4,386,156 discloses a method for preparing a tabular silver bromide emulsion having an average aspect ratio of 8 or more by ripening seed grains in the absence of non-silver halide ion complexing agents.

As described above, emulsions consisting of tabular silver bromide grains having (100) crystal faces as their major faces have been reported. To use these emulsions as silver halide photographic light-sensitive materials, however, further improvements are required in particularly photographic sensitivity.

SUMMARY OF THE INVENTION

It is an object of the present invention to provide a silver halide emulsion excellent in particularly photographic sensitivity by containing iodide as the halogen composition of a silver halide, and a photographic light-sensitive material using the emulsion.

The above object of the present invention is achieved by the following means.

(1) A silver halide emulsion, wherein tabular silver halide grains substantially consisting of silver bromoiodide, each having (100) faces as two parallel major faces, an aspect ratio of 2 or more, and an average silver iodide content of 1 mol % or more, account for 50% or more of a total projected area of silver halide grains.

(2) A silver halide photographic light-sensitive material, wherein at least one silver halide emulsion layer formed on a support contains a silver halide emulsion described in item (1) above.

(3) The silver halide photographic light-sensitive material described in item (2) above, wherein the average silver iodide content of the tabular grains is 2.5 mol % or more.

(4) The silver halide photographic light-sensitive material described in item (2) above, wherein the tabular grains are subjected to gold sensitization and sulfur sensitization.

(5) The silver halide photographic light-sensitive material described in item (2) above, wherein the tabular grains are spectrally sensitized with cyanine dyes.

(6) The silver halide photographic light-sensitive material described in item (2) above, wherein the tabular grains are subjected to gold sensitization and sulfur sensitization in the presence of cyanine dyes.

DETAILED DESCRIPTION OF THE PREFERRED EMBODIMENTS

A silver halide emulsion of the present invention will be described below.

A tabular grain emulsion useful in the present invention can be formed by first preparing a small-size cubic seed grain emulsion and then ripening it.

The small-size cubic seed grain emulsion can be formed by conventional techniques. A preferable seed grain emulsion is prepared by a double-jet method. That is, first, an aqueous silver salt solution, such as an aqueous silver nitrate solution, and an aqueous solution of a halide of sodium or potassium are simultaneously poured in a reactor vessel. Although the concentration of each aqueous solution may be approximately 0.2 mol to a saturated one, stirring is preferably performed rapidly and uniformly. The concentration is preferably less than 4 mol %, and more preferably 2 to 0.1 mol.

To form favorable seed grains, it is preferable to control the pAg in the reactor vessel during precipitation. For this purpose, the pAg is preferably kept in a range of 2.5 to 8.5. If the pAg is either smaller or larger than this range, grains having twin planes are undesirably formed. In addition, in terms of stability in production, a pAg at an equilibrium point, i.e., a pAg at which the concentration of silver is stoichiometrically equal to that of halide ion is unpreferable. To finally obtain a silver halide emulsion with a high aspect ratio, the pAg is preferably 6.5 to 8.3, and more preferably 7.0 to 8.0. The term "aspect ratio" used herein means the ratio of the thickness between major faces of a grain to the average length of edges forming the major faces. The "major faces" are defined as a pair of parallel faces having the largest area of crystal surfaces forming a substantially rectangular parallelepiped emulsion grain. Whether the major face is a (100) face can be checked by an electron diffraction method or an X-ray diffraction method. The substantially rectangular parallelepiped emulsion grain is a grain that has (100) faces as its major faces but can also have one to eight (111) crystal faces. That is, the substantially rectangular parallelepiped emulsion grain may take a shape in which one to eight of the eight corners of a rectangle are chipped. The "average edge length" is defined as the length of a side of a square having an area equal to the projected area of a grain observed in an electron micrograph of an emulsion grain sample.

The seed grain precipitation temperature has an effect on an optimal value of pAg but can be set at a temperature known to be useful in preparation of an emulsion with a desired grain size. The temperature is preferably about 25° to 75° C., and more preferably 45° C. or less.

The pH is preferably kept at approximately 2.0 to 5.0 in order to suppress ripening during formation of seed grains. Nitric acid, sulfuric acid, or acetic acid can be used to control the pH.

After the precipitation, Ostwald ripening is performed for the cubic seed grain emulsion to prepare tabular grains.

During the ripening, it is preferable to control the pAg in the reactor vessel. The aspect ratio can be controlled by setting the pAg during the ripening to 5.2 to 6.2. If the pAg is smaller than this range, the aspect ratio of the resultant tabular grains becomes too small; if the pAg is too large, the ripening is inhibited. A more preferable range of the pAg for obtaining tabular grains with a high aspect ratio is 5.5 to 5.8.

The ripening temperature has an influence on an optimal value of pAg but can be set at a temperature known to be useful in preparation of an emulsion with a desired grain size. The temperature is preferably about 50° to 80° C.

To accelerate the ripening, the pH is preferably kept at approximately 5.0 to 9.0. Sodium hydroxide or potassium hydroxide can be used to control the pH.

An X-ray diffraction method is known as a method of examining the halogen composition of silver halide crystal. Measurements using X-ray diffraction are described in detail in, e.g., Basic Analytical Chemistry Course Vol. 24, "X-Ray Diffraction," (Kyoritsu Shuppan) and "Introduction to X-Ray Diffraction," (Rigaku Denki K.K.) A standard measurement method is to obtain a diffraction curve of a (420) face of a silver halide in accordance with a powder method by using Cu as a target and Kβ rays of Cu as a radiation source at a tube voltage of 40 kV and a tube current of 60 mA. To increase the accuracy of the measurement, it is necessary to appropriately select the width of a slit (e.g., a diverging/light-receiving slit), the time constant of an apparatus, the scan rate of a goniometer, and the recording rate, and to correct the diffraction angle by using a standard sample such as silicon.

By measuring a diffraction angle 2θ by the X-ray diffraction method, a lattice constant a can be determined from a Bragg's equation:

$$2d \sin \theta = \lambda$$

$$d = a/(h^2+k^2+1^2)^{1/2}$$

where 2θ is the diffraction angle of an (hkl) face, λ is the wavelength of X-rays, and d is the face-to-face distance of (hkl) faces. The relationship between the halogen composition of a silver halide solid solution and the lattice constant a is described in T. H. James ed., "The Theory of The Photographic Process Fourth Edition," Macmillan, New York, (1977). In the case of silver bromoiodide, an iodide concentration [I] of halogen and the lattice constant a satisfy the following relation:

$$a(A) = 5.7748 + 0.00368[I]$$

In this manner, the halogen composition of a silver halide can be checked by the diffraction angle of X-rays.

The present invention is based on the invention of introducing iodide to tabular grains formed by ripening and having (100) faces as their major faces. The average silver iodide content of the tabular grains present in an emulsion, which is obtained by the above x-ray diffraction method, is 1 mol % or more, preferably 1 to 5 mol %, and more preferably 2.5 to 5 mol %. When the average silver iodide content is less than 1 mol %, the effect of the high sensitivity is small, whereas when the content exceeds 5 mol %, the growth in the direction perpendicular to (100) major faces is promoted, lowering the aspect ratio. As a result, the advantage of the invention cannot be exhibited.

In this case, iodide may be either distributed uniformly across a grain or localized to a portion of the grain. It is preferable that the silver iodide content close to the surface of a grain be higher than the average silver iodide content of the grain.

The silver iodide content of the surface of a silver halide grain according to the present invention can be detected by various surface element analyzing means. The use of XPS, Auger electron spectroscopy, or ISS is effective. Means which is simplest and yet has a high accuracy is XPS (X-ray Photoelectron Spectroscopy).

A depth that can be analyzed by the XPS surface analysis method is said to be about 10 Å.

The principle of the XPS method used in analysis of the iodide content near the surface of a silver halide grain is described in Junichi Aihara et al., "Electron Spectroscopy" (Kyoritsu Library Vol. 16, Kyoritsu Shuppan, 1978).

A standard measurement method of the XPS is to measure the intensities of photoelectrons of iodine (I) and silver (Ag) (normally I–$3d_{5/2}$ and Ag–$3d_{5/2}$) emitted from silver halide grains in a proper sample form by using MgKα as excitation X-rays.

The iodide content can be obtained from calibration curves of a photoelectron intensity ratio (intensity (I)/intensity (Ag)) of iodine (I) and silver (Ag) formed by using several different types of standard samples whose iodide contents are known. In a silver halide emulsion, gelatin that is adsorbed to the surface of a silver halide grain must be removed by decomposition by using, e.g., a proteolytic enzyme before the XPS measurement.

The fact that the silver iodide content near the surface of a tabular grain of the present invention is higher than the average silver iodide content of the grain can be checked by the XPS surface analysis method described above.

Iodide can be introduced by adding an aqueous silver nitrate solution and an aqueous potassium iodide solution, or an aqueous solution mixture of potassium iodide and potassium bromide, to a host grain consisting of pure silver bromide or having a low iodide content by a double-jet method, thereby forming a silver iodide layer on the grain. Iodide can also be introduced through so-called halogen conversion, in which ripening is performed by adding an aqueous potassium iodide solution, or by performing ripening by adding silver iodide fine grains.

A silver halide emulsion of the present invention substantially consists of silver bromoiodide. In this case, "substantially consists of silver bromoiodide" means that the average silver chloride content of tabular grains is 1 mol % or less, preferably 0.1 mol % or less. Tabular grains having a high silver chloride content and two (100) major faces arranged in parallel with each other have been known in this technical field; however the silver halide emulsion of the present invention contains little silver halide, but contains iodide as the halogen composition.

The characteristic feature of a silver halide emulsion for use in the present invention which can be prepared by the above method is that at least 50% of the total projected area of silver halide grains present in the emulsion are accounted for by grains substantially consisting of silver bromoiodide and having an aspect ratio of 2 or more, preferably 5 or more. The aspect ratio should be 2 or more and 50 or less, and preferably 5 or more and 50 or less. This is because when the aspect ratio is less than 2, the effect of the present invention is not exhibited, whereas the aspect ratio exceeds 50, there rise the problem of the pressure property. In addition, it is preferable that the grain size of the silver bromoiodide grains be 0.2 to 3.0 μm as a diameter as sphere, and the variation coefficient of the grain size be 25% or less as a diameter as sphere.

The light-sensitive material of the present invention needs only to have at least one of the silver halide emulsion layers, i.e., a blue-sensitive layer, a green-sensitive layer, or a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Pat. No. 1,121,470 or British Pat. No. 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted.

Furthermore, the arrangement can be changed as described above even when four or more layers are formed.

As described above, various layer configurations and arrangements can be selected in accordance with the application of the light-sensitive material.

A photographic light-sensitive material of the present invention is a silver halide photographic light-sensitive material in which at least one silver halide emulsion layer formed on a support contains 30% or more, preferably 50% or more, and more preferably 70% or more of the silver halide emulsion of the present invention.

A silver halide except for that of the present invention, which can be contained in the photographic emulsion layer of the photographic light-sensitive material of the present invention, is preferably silver bromoiodide, silver iodochloride, or silver bromochloroiodide, that contains about 30 mol % or less of silver iodide. This silver halide is most preferably silver bromoiodide or silver bromochloroiodide containing about 2 mol % to about 10 mol % of silver iodide.

Silver halide grains, except for the silver halide grains of the present invention, contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide except for the silver of the present invention may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Pat. No. 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Pat. No. 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of chalcogen sensitization (e.g., sulfur sensitization and selenium sensitization), noble metal sensitization (e.g., gold sensitization and palladium sensitization), and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Pat. No. 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526 ("JP-A" means Published Unexamined Japanese Pat. No. Application), and G. F. Duffin, Photographic Emulsion Chemistry, pages 138 to 143.

It is preferable to perform both gold sensitization and sulfur sensitization for emulsions of the present invention. An amount of each of a gold sensitizer and a sulfur sensitizer is preferably $1\times10^{-4}$ to $1\times10^{-7}$ mol, and more preferably $1\times10^{-5}$ to $5\times10^{-7}$ mol per mol of a silver halide.

Selenium sensitization is a preferable sensitizing method for emulsion of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mol per mol of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a proper timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones (e.g., p-quinone), an organic peroxide (e.g., peracetic acid and perbenzoic acid), and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions for use in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 ("JP-B" means Published Examined Japanese Patent Application) can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may have substituents on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The sensitizing dyes can be added to an emulsion at any step in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

Silver halide emulsions of the present invention are preferably, spectrally sensitized with cyanine dyes. These sensitizing dyes are added to an emulsion preferably at the same timing as the chemical sensitizers, and more preferably before chemical sensitization. Most preferably, the tabular grains of the present invention are subjected to gold sensitization and sulfer sensitization in the presence of cyanine dyes.

The addition amount may be $4\times10^{-6}$ to $8\times10^{-3}$ mol per mol of a silver halide. However, for a more preferable silver halide grain size of 0.2 to 1.2 μm, an addition amount of about $5\times10^{-5}$ to $2\times10^{-3}$ mol is more effective.

Although the various additives described above can be used in the emulsions according to the present invention, a variety of other additives can also be used in accordance with the intended use.

The details of these additives are described in Research Disclosures Item 17643 (December, 1978), Item 18716 (November, 1979), and Item 308119 (December, 1989), and these portions are summarized in Table 1 below.

TABLE 1

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column column to page 649, right column | page 996, right column to page 998, right column |
| 4. Brighteners | page 24 | | page 998, right column |
| 5. Antifoggants and stabilizers | pages 24–25 | page 649, right column | page 998, right column to page 1,000, right column |
| 6. Light absorbent, filter dye, ultra-violet absorbents | pages 25–26 | page 649, right column to page 650, left column | page 1,003, left to right columns |
| 7. Stain preventing agents | page 25, right column | page 650, left to right columns | page 1,002, right column |
| 8. Dye image stabilizer | page 25 | page 650, left column | page 1,002, right column |
| 9. Hardening agents | page 26 | page 651, left column | page 1,004, right column to page 1,005, left column |
| 10. Binder | page 26 | page 651, left column | page 1,003, right column to page 1,004, right column |
| 11. Plasticizers, lubricants | page 27 | page 650, right column | page 1,006, left to right columns |
| 12. Coating aids, surface active agents | pages 26–27 | page, 650, right column | page 1,005, left column to page 1,006, left column |
| 13. Antistatic agents | page 27 | page 650, right column | page 1,006, right column to page 1,007, left column |
| 14. Matting agents | | | page 1,008, left column to page 1,009, left column |

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of ±40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the Table aforementioned.

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-18951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Typical examples of a polymerized dye-forming coupler are described in, e.g., U.S. Pat. Nos. 3,451,820; 4,080,211; 4,367,282; 4,409,320 and 4,576,910, British Patent No. 2,102,173, and European Patent No. 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027.

Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl-)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness–film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline sulfate is preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patent 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid or propionic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Pat. No. 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

A silver halide light-sensitive material of the present invention can also be applied to thermal development light-sensitive materials described in, e.g., U.S. Pat. No. 4,500,626, JP-A-60-133449, JP-A-59-218443, JP-A-61-238056, and EP210,660A2.

The present invention will be described in more detail below by way of its examples, but the invention is not limited to these examples.

EXAMPLE 1

Emulsions described below were prepared referring to the description of U.S. Pat. No. 4,386,156.

Preparation of Emulsion A:

40 g of gelatin were dissolved in 2,000 ml of distilled water, and the resultant solution was kept at 40° C. with stirring in a reactor vessel. After the pH of the solution was controlled to 3.00 by using nitric acid, 31.1 ml of an aqueous 1M silver nitrate solution and 31.1 ml of an aqueous 1M potassium bromide solution were added to the solution over 20 seconds. The average edge length of the resultant cubic seed grains was approximately 0.04 μm. After the addition, the pAg was controlled to 6.61 by using an aqueous silver nitrate solution, the pH was controlled to 6.00 by using an aqueous sodium hydroxide solution, and the temperature was raised to 75° C. The pAg was controlled to 5.79 immediately after the temperature rise, and physical ripening was performed for two hours and 30 minutes. The resultant emulsion was concentrated to 200 ml by performing centrifugal separation at 6,000 rpm for 10 minutes. The procedures so far were repeated five times, and the resultant concentrated emulsions were mixed and added with 5 g of gelatin.

In the resultant emulsion A, tabular silver halide grains, each having (100) faces as two parallel major faces and an aspect ratio of 2 or more, occupied 85% of the total projected area of silver halide grains. The average edge length was 1.12 μm, and the thickness between the major faces was 0.10 μm.

Preparation of Emulsion B:

40 g of gelatin were dissolved in 2,000 ml of distilled water, and the resultant solution was kept at 40° C. with stirring in a reactor vessel. After the pH of the solution was controlled to 3.00 by using nitric acid, 31.1 ml of an aqueous 1 M silver nitrate solution and 31.1 ml of an aqueous 1 M potassium bromide solution were added to the solution over 20 seconds. After the addition, the pAg was controlled to 6.61 by using an aqueous silver nitrate solution, the pH was controlled to 6.00 by using an aqueous sodium hydroxide solution, and the temperature was raised to 75° C. The pAg was controlled to 5.79 immediately after the temperature rise, and physical ripening was performed for two hours. Subsequently, 18.7 ml of an aqueous 0.01M silver nitrate solution and an aqueous 0.01M potassium iodide solution were added to the emulsion over 30 minutes by a controlled double-jet method with the pAg kept at 5.79. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion B, tabular silver halide grains substantially consisting of silver bromoiodide, each having (100) faces as two parallel major faces and an aspect ratio of 2 or more, occupied 84% of the total projected area of silver halide grains. The average edge length was 1.12 μm, the thickness between the major faces was 0.10 μm, and the silver iodide content with respect to silver bromide was 0.6 mol %.

Preparation of Emulsion C:

In the preparation of the emulsion B, after the physical ripening for two hours, 37.3 ml of an aqueous 0.01M silver nitrate solution and an aqueous 0.01M potassium iodide solution were added to the emulsion over 30 minutes by the controlled double-jet method with the pAg kept at 5.79. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion C, tabular silver halide grains substantially consisting of silver bromoiodide, each having (100) faces as two parallel major faces, an aspect ratio of 2 or more, and an average silver iodide content of 1 mol % or more, occupied 87% of the total projected area of silver halide grains. The average edge length was 1.12 μm, the thickness between the major faces was 0.10 μm, and the silver iodide content with respect to silver bromide was 1.2 mol %.

Preparation of Emulsion D:

In the preparation of the emulsion B, after the physical ripening for two hours, 56.0 ml of an aqueous 0.01M silver nitrate solution and an aqueous 0.01M potassium iodide solution were added to the emulsion over 30 minutes by the controlled double-jet method with the pAg kept at 5.79. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion D, tabular silver halide grains substantially consisting of silver bromoiodide, each having (100) faces as two parallel major faces, an aspect ratio of 2 or more, and an average silver iodide content of 1 mol % or more, occupied 85% of the total projected area of silver halide grains. The average edge length was 1.12 μm, the thickness between the major faces was 0.10 μm, and the silver iodide content with respect to silver bromide was 1.8 mol %.

Preparation of Emulsion E:

In the preparation of the emulsion B, after the physical ripening for two hours, 74.6 ml of an aqueous 0.01M silver nitrate solution and an aqueous 0.01M potassium iodide solution were added to the emulsion over 30 minutes by the controlled double-jet method with the pAg kept at 5.79. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion E, tabular silver halide grains substantially consisting of silver bromoiodide, each having (100) faces as two parallel major faces, an aspect ratio of 2 or more, and an average silver iodide content of 1 mol % or more, occupied 86% of the total projected area of silver halide grains. The average edge length was 1.12 μm, the thickness between the major faces was 0.10 μm, and the silver iodide content with respect to silver bromide was 2.4 mol %.

Preparation of Emulsion F:

In the preparation of the emulsion B, after the physical ripening for two hours, 112.0 ml of an aqueous 0.01M silver nitrate solution and an aqueous 0.01M potassium iodide solution were added to the emulsion over 30 minutes by the controlled double-jet method with the pAg kept at 5.79. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion F, tabular silver halide grains substantially consisting of silver bromoiodide, each having (100) faces as two parallel major faces, an aspect ratio of 2 or more, and an average silver iodide content of 1 mol % or more, occupied 85% of the total projected area of silver halide grains. The average edge length was 1.12 μm, the thickness between the major faces was 0.10 μm, and the silver iodide content with respect to silver bromide was 3.6 mol %.

Preparation of Emulsion G:

First, a silver bromide cubic emulsion having an average edge length of 0.50 μm was prepared. Subsequently, an aqueous silver nitrate solution and an aqueous potassium iodide solution were added to the emulsion by the controlled double-jet method, preparing a silver bromoiodide cubic emulsion G having a silver iodide content with respect to silver bromide of 1.2 mol %.

Preparation of Emulsion H:

An emulsion was prepared referring to the description of U.S. Pat. No. 4,063,951. The resultant emulsion H was found to contain silver bromoiodide tabular grains, each having (100) faces as major faces. The average edge length was 0.91 μm, the thickness between the major faces was 0.16 μm, and the silver iodide content with respect to silver bromide was 0.5 mol %.

Preparation of Emulsion I:

40 g of gelatin were dissolved in 2,000 ml of distilled water, and the resultant solution was kept at 40° C. with stirring in a reactor vessel. After the pH of the solution was controlled to 3.00 by using nitric acid, 31.1 ml of an aqueous 1M silver nitrate solution and 31.1 ml of an aqueous 1M potassium bromide solution were added to the solution over 20 seconds. After the addition, the pAg was controlled to 6.61 by using an aqueous silver nitrate solution, the pH was controlled to 6.00 by using an aqueous sodium hydroxide solution, and the temperature was raised to 75° C. The pAg was controlled to 5.79 immediately after the temperature rise, and physical ripening was performed for two hours. Subsequently, an emulsion containing 87.6 mg of silver iodide fine grains with an average grain size of 0.03 μm was added to the emulsion, and the emulsion was ripened for 30 minutes. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion I, tabular silver halide grains substantially consisting of silver bromoiodide, each having (100) faces as two parallel major faces, an aspect ratio of 2 or more, and an average silver iodide content of 1 mol % or more, occupied 83% of the total projected area of silver halide grains. The average edge length was 1.12 μm, the thickness between the major faces was 0.10 μm, and the silver iodide content with respect to silver bromide was 1.2 mol %.

Preparation of Emulsion J:

40 g of gelatin were dissolved in 2,000 ml of distilled water, and the resultant solution was kept at 40° C. with stirring in a reactor vessel. After the pH of the solution was controlled to 3.00 by using nitric acid, 31.1 ml of an aqueous 1M silver nitrate solution and 31.1 ml of an aqueous 1M potassium bromide solution were added to the solution over 20 seconds. After the addition, the pAg was controlled to 6.61 by using an aqueous silver nitrate solution, the pH was controlled to 6.00 by using an aqueous sodium hydroxide solution, and the temperature was raised to 75° C. The pAg was controlled to 5.79 immediately after the temperature rise, and physical ripening was performed for two hours. Subsequently, 37.3 ml of an aqueous 0.01M potassium iodide solution were added to the emulsion over 30 minutes by a single-jet method. The resultant emulsion was concentrated to 200 ml by performing centrifugal separation at 6,000 rpm for 10 minutes. The procedures so far were repeated five times, and the resultant concentrated emulsions were mixed and added with 5 g of gelatin. In the resultant emulsion J, tabular silver halide grains substantially consisting of silver bromoiodide, each having (100) faces as two parallel major faces, an aspect ratio of 2 or more, and an average silver iodide content of 1 mol % or more, occupied 85% of the total projected area of silver halide grains. The average edge length was 1.12 μm, the thickness between the major faces was 0.10 μm, and the silver iodide content with respect to silver bromide was 1.2 mol %.

Chemical sensitization described below was performed for the emulsions A to J at 60° C., pH 6.20, and pAg 8.40.

First, a sensitizing dye shown below was added in an amount of $1.6\times10^{-3}$ mol per mol of silver.

Sensitizing dye

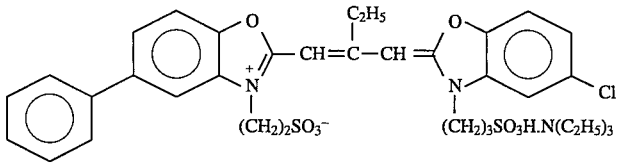

Subsequently, potassium thiocyanate, potassium chloroaurate, and sodium thiosulfate in amounts of $3.0\times10^{-3}$ mol, $6\times10^{-6}$ mol, and $1\times10^{-5}$ mol, respectively, per mol of silver, and a selenium sensitizer shown below in an amount of $3\times10^{-6}$ mol per mol of a silver halide were added, thereby ripening the emulsions at 60° C. while the ripening time was controlled such that a highest sensitivity was obtained by 1/100-sec exposure.

Selenium sensitizer

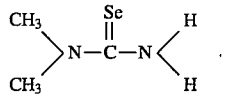

After the chemical sensitization, compounds shown below were added to the resultant emulsions, and each emulsion, and a protective layer, were coated on a triacetylcellulose film support having a subbing layer by a co-extrusion method such that the silver amount was 0.5 g/m$^2$.

(1) Emulsion layer

Emulsion . . . one of Emulsions A–J

Compound 1

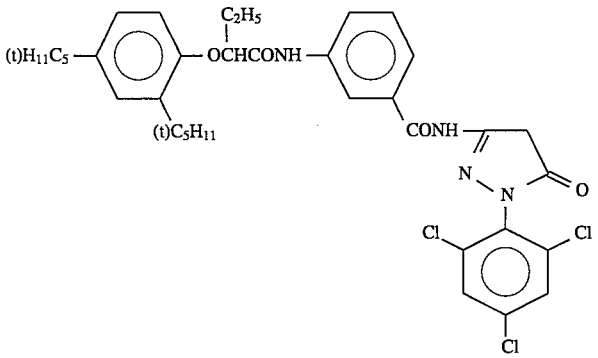

Stabilizer 4-hydroxy-6-methyl-1,3,3a,7-tetrazaindene

Coating aid Sodium dodecylbenzenesulfonate (2) Protective layer

Polymethylmethacrylate fine grains 2,4-dichloro-6-hydroxy-s-triazine sodium salt Gelatin These samples were subjected to sensitometry exposure (1/100 second) and color development presented below.

The development was performed at 38° C. under the following conditions.

| | |
|---|---|
| 1. Color development | 2 min. 45 sec. |
| 2. Bleaching | 6 min. 30 sec. |
| 3. Washing | 3 min. 15 sec. |
| 4. Fixing | 6 min. 30 sec. |

-continued

| | |
|---|---|
| 5. Washing | 3 min. 15 sec. |
| 6. Stabilization | 3 min. 15 sec. |

The processing compositions used in the individual steps were as follows.

| | |
|---|---|
| Color developing solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methyl-aniline sulfate | 4.5 g |
| Water to make | 1 l |
| Bleaching solution | |
| Ammonium bromide | 160.0 g |
| Ammonia water (28%) | 25.0 ml |
| Ferric ammonium ethylenediaminetetraacetate dihydrate | 120 g |
| Disodium ethylenediamine-tetraacetate | 10.0 g |
| Glacial acetic acid | 14 ml |
| Water to make | 1 l |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 l |
| Stabilizing solution | |
| Formalin | 8.0 ml |
| Water to make | 1 l |

The density of each processed sample was measured through a green filter.

The sensitivity was defined by the reciprocal of an exposure amount by which a density of fog +0.1 was given and represented by a relative value assuming that the value of a sample 1 was 100. The values of sensitivity and fog, together with iodide contents measured by an X-ray diffraction method, are summarized in Table 2 below.

TABLE 2

| Sample No. | Emulsion name | Iodide content | Sensitivity | Fog | Remarks |
|---|---|---|---|---|---|
| 1 | A | 0 mol % | 100 | 0.20 | Comparative example |
| 2 | B | 0.6 mol % | 109 | 0.25 | Comparative example |
| 3 | C | 1.2 mol % | 127 | 0.18 | Present invention |
| 4 | D | 1.8 mol % | 129 | 0.16 | Present invention |
| 5 | E | 2.4 mol % | 130 | 0.19 | Present invention |
| 6 | F | 3.6 mol % | 135 | 0.17 | Present invention |
| 7 | G | 1.2 mol % | 115 | 0.28 | Comparative example |
| 8 | H | 0.5 mol % | 112 | 0.26 | Comparative example |
| 9 | I | 1.2 mol % | 130 | 0.19 | Present invention |
| 10 | J | 1.2 mol % | 127 | 0.20 | Present invention |

Table 2 reveals that each silver halide emulsion according to the present invention had a high sensitivity and a low fog.

EXAMPLE 2

Multiple layers having the compositions presented below were coated on a subbed triacetylcellulose film support to make a sample 101 as a multilayered color light-sensitive material.

(Compositions of light-sensitive layers)

The main materials used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of g/m$^2$. The coating amount of a silver halide is represented by the amount of silver. The coating amount of each sensitizing dye is represented in units of mols per mol of a silver halide in the same layer.

| | | |
|---|---|---|
| 1st layer (Antihalation layer) | | |
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |
| 2nd layer (Interlayer) | | |
| Emulsion Q | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| 3rd layer (Low-speed red-sensitive emulsion layer) | | |
| Emulsion K | silver | 0.25 |
| Emulsion L | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| EXC-8 | | 0.010 |
| Cpd-2 | | 0.025 |
| HBS-1 | | 0.10 |
| Gelatin | | 0.87 |
| 4th layer (Medium-speed red-sensitive emulsion layer) | | |
| Emulsion N | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |
| 5th layer (High-speed red-sensitive emulsion layer) | | |
| Emulsion O | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |

-continued

| | | |
|---|---|---|
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |
| 6th layer (Interlayer) | | |
| Cpd-1 | | 0.10 |
| HBS-1 | | 0.50 |
| Gelatin | | 1.10 |
| 7th layer (Low-speed green-sensitive emulsion layer) | | |
| Emulsion M | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Emulsion N | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |
| 9th layer (High-speed green-sensitive emulsion layer) | | |
| Emulsion A (prepared in EXAMPLE 1) | silver | 1.25 |
| ExC-1 | | 0.010 |
| ExM-1 | | 0.030 |
| ExM-4 | | 0.040 |
| ExM-5 | | 0.019 |
| Cpd-3 | | 0.040 |
| HBS-1 | | 0.25 |
| HBS-2 | | 0.10 |
| Gelatin | | 1.44 |
| 10th layer (Yellow filter layer) | | |
| Yellow colloidal silver | silver | 0.030 |
| Cpd-1 | | 0.16 |
| HBS-1 | | 0.60 |

-continued

| | | |
|---|---|---|
| Gelatin | | 0.60 |
| 11th layer (Low-speed blue-sensitive emulsion layer) | | |
| Emulsion M | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |
| Gelatin | | 1.10 |
| 12th layer (Medium-speed blue-sensitive emulsion layer) | | |
| Emulsion N | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |
| 13th layer (High-speed blue-sensitive emulsion layer) | | |
| Emulsion P | silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |
| 14th layer (1st protective layer) | | |
| Emulsion Q | silver | 0.20 |
| UV-4 | | 0.11 |
| UV-5 | | 0.17 |
| HBS-1 | | $5.0 \times 10^{-2}$ |
| Gelatin | | 1.00 |
| 15th layer (2nd protective layer) | | |
| H-1 | | 0.40 |
| B-1 (diameter 1.7 fm) | | $5.0 \times 10^{-2}$ |
| B-2 (diameter 1.7 fm) | | 0.10 |
| B-3 | | 0.10 |
| S-1 | | 0.20 |
| Gelatin | | 1.20 |

In addition to the above components, to improve storage stability, processibility, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The emulsions used are listed in Table 3 below.

TABLE 3

| Emulsion name | Average AgI content (%) | Average grain size (μm) | Variation coefficient (%) according to grain size | Diameter/thickness ratio | Silver amount ratio [Core/intermediate/shell] (AgI content) | Grain structure/shape |
|---|---|---|---|---|---|---|
| Emulsion K | 4.0 | 0.45 | 27 | 1 | [1/3] (13/1) | Double structure octahedral grain |
| Emulsion L | 8.9 | 0.70 | 14 | 1 | [3/7] (25/2) | Double structure octahedral grain |
| Emulsion M | 2.0 | 0.55 | 25 | 7 | — | Uniform structure tabular grain |
| Emulsion N | 9.0 | 0.65 | 25 | 6 | [12/59/29] (0/11/8) | Triple structure tabular grain |
| Emulsion O | 9.0 | 0.85 | 23 | 5 | [8/59/33] (0/11/8) | Triple structure tabular grain |
| Emulsion P | 14.5 | 1.25 | 25 | 3 | [37/63] (34/3) | Double structure tabular grain |
| Emulsion Q | 1.0 | 0.07 | 15 | 1 | — | Uniform structure fine grain |

In Table 3, (1) The emulsions K to P were subjected to reduction sensitization during grain preparation by using thiourea dioxide and thiosulfonic acid in accordance with the embodiments in JP-A-2-191938.

(2) The emulsions K to P were subjected to gold sensitization, sulfur sensitization, and selenium sensitization in the presence of the spectral sensitizing dyes described in the individual light-sensitive layers and sodium thiocyanate in accordance with the embodiments in JP-A-3-237450.

(3) The preparation of tabular grains was performed by using low-molecular weight gelatin in accordance with the embodiments in JP-A-1-158426.

(4) Dislocation lines as described in JP-A-3-237450 were observed in tabular grains and regular crystal grains having a grain structure when a high-voltage electron microscope was used.

The chemical structures of the constituent components of the individual layers are presented below.

ExC-1

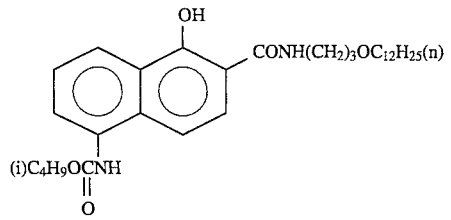

ExC-2

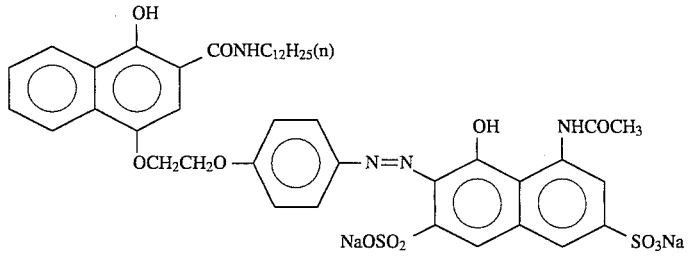

ExC-3

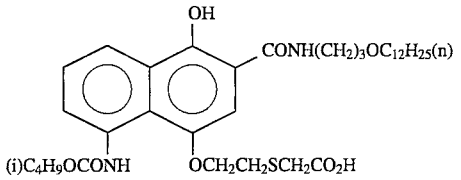

ExC-4

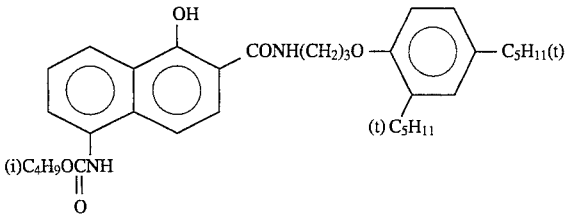

ExC-5

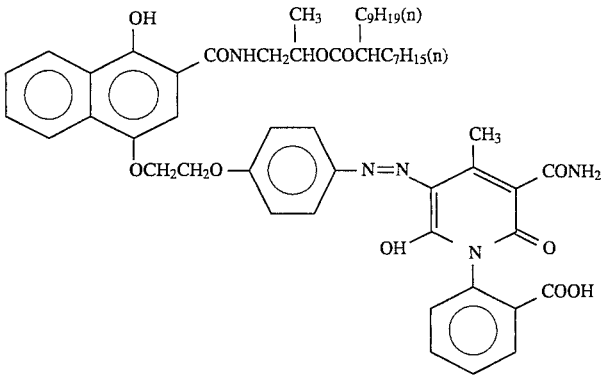

-continued
ExC-6
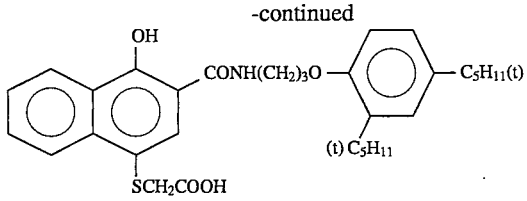
ExC-7
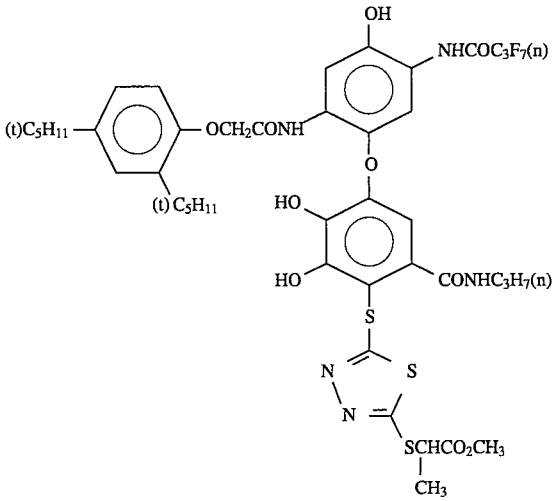
ExC-8
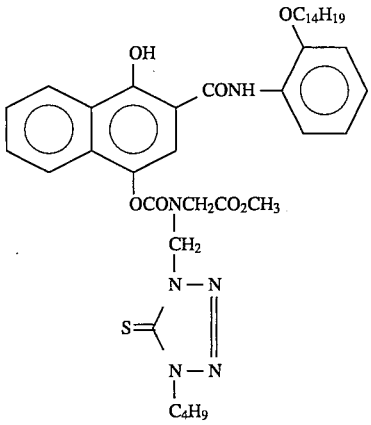
ExM-1
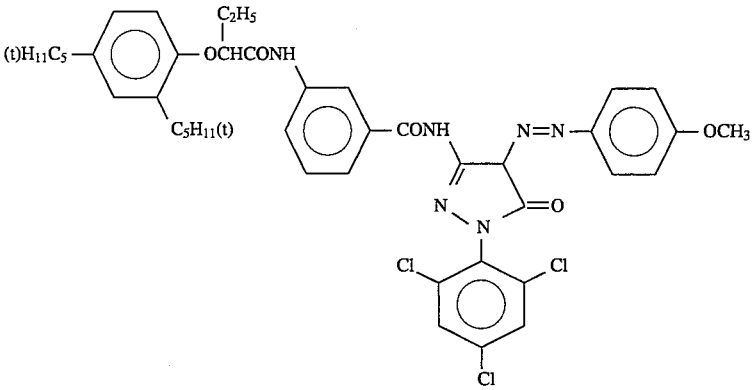

-continued
ExM-2
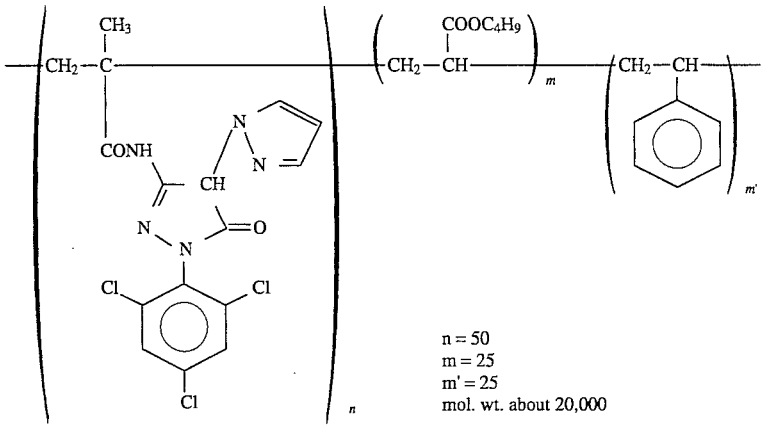
n = 50
m = 25
m' = 25
mol. wt. about 20,000
ExM-3
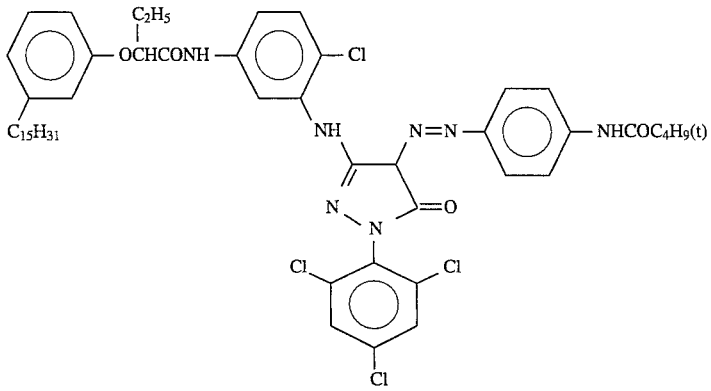
ExM-4
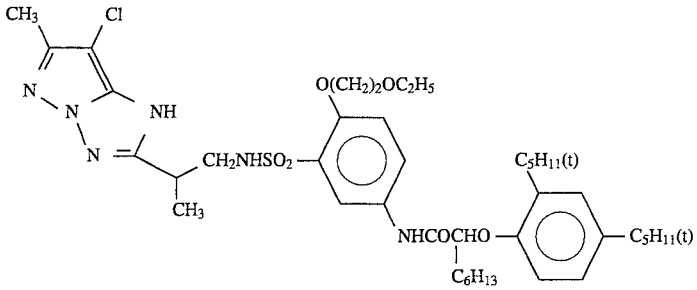
ExM-5
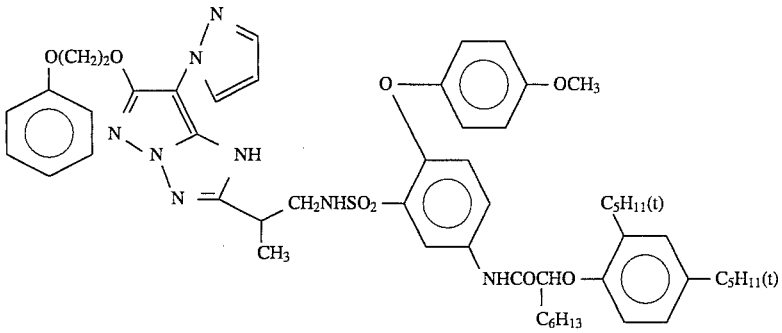

-continued
ExY-1
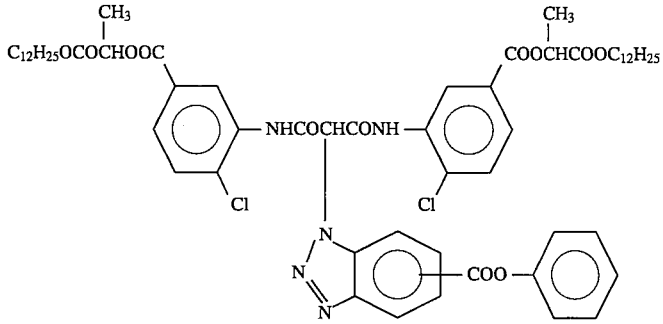
ExY-2
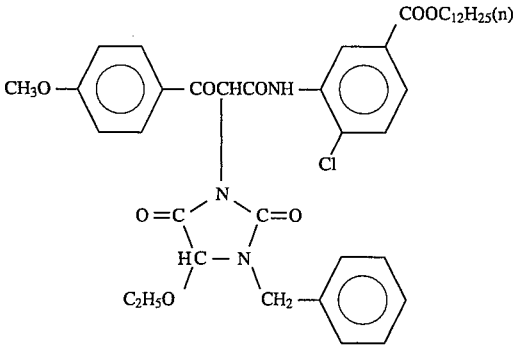
ExY-3
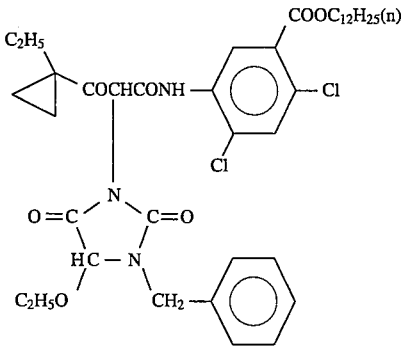
ExY-4
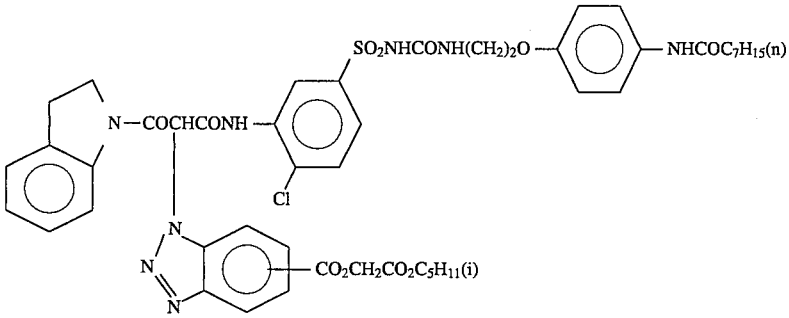
ExF-1
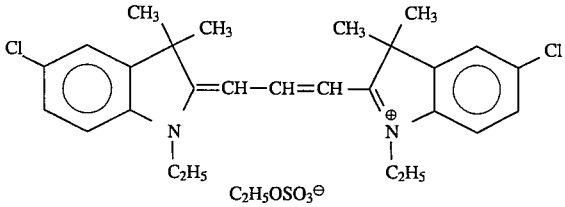
Cpd-1
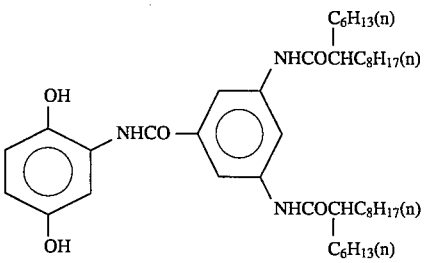
Cpd-2
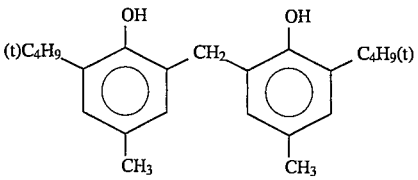
Cpd-3
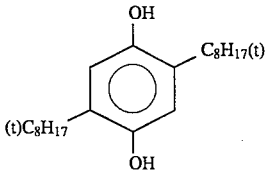
UV-1
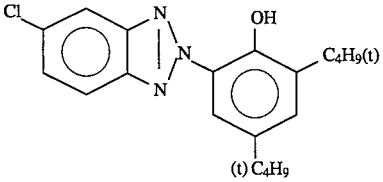

-continued
UV-2
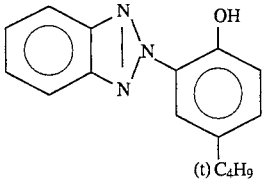
UV-3
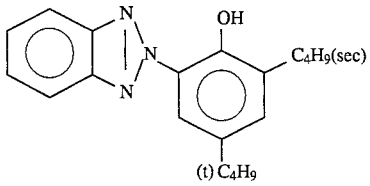
UV-4
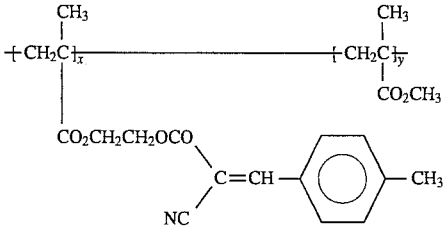
x:y = 70:30 (wt %)
UV-5
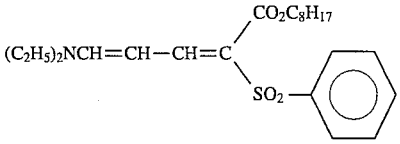
tricresyl phosphate HBS-1
di-n-butyl phtalate HBS-2
HBS-3
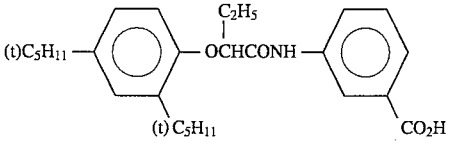
ExS-1
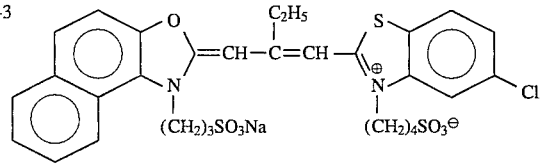
ExS-2
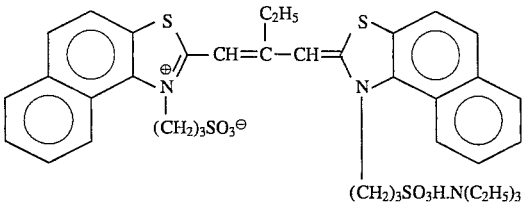
ExS-3
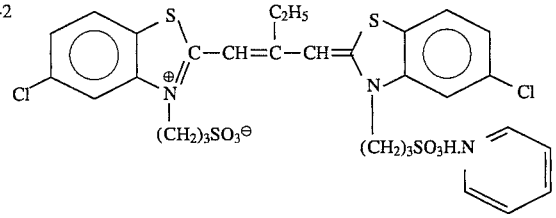
ExS-4
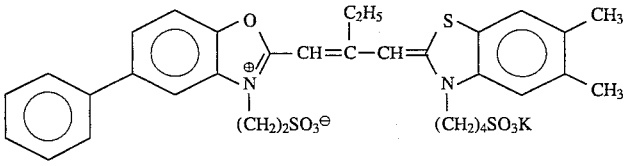
ExS-5
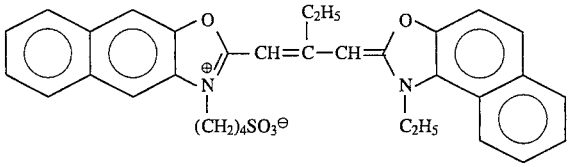
ExS-6
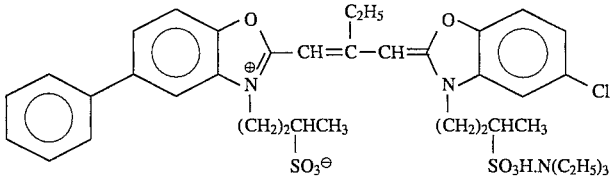
ExS-7
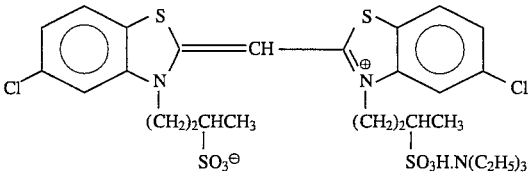

-continued
S-1
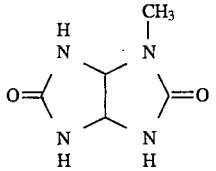
H-1
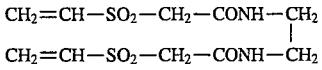
B-1
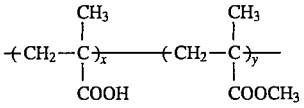
x/y = 10/90
B-2
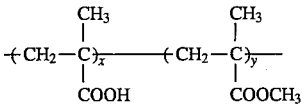
x/y = 40/60
B-3
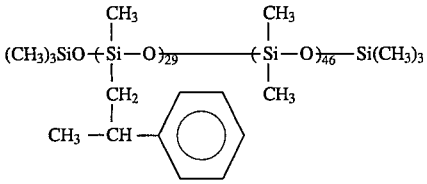
B-4
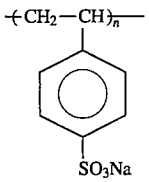
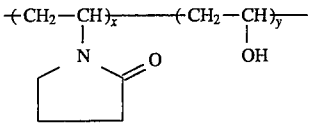
x/y = 70/30
B-5
B-6
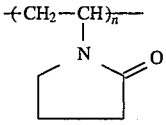
(mol. wt. about 10,000)
W-1
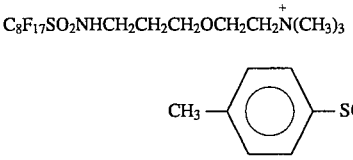
W-2
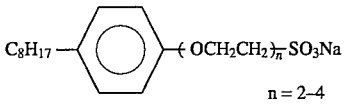
n = 2–4
W-3
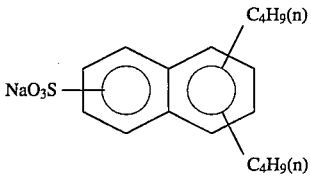
F-1
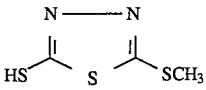
F-2
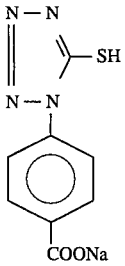
F-3
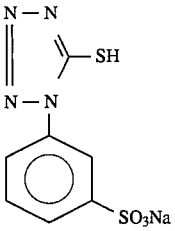
F-4
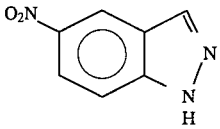
F-5
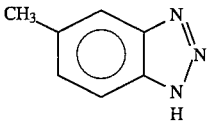
F-6
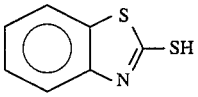
F-7
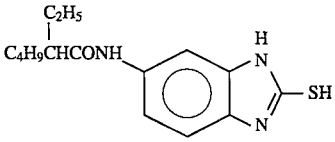

-continued

F-8

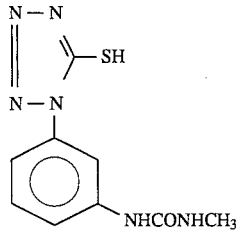

F-9

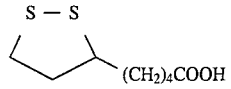

F-10

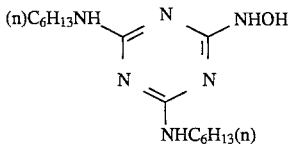

F-11

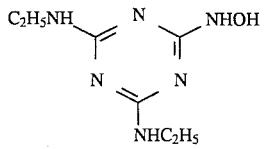

F-12

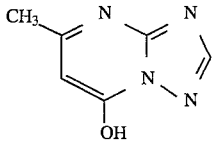

F-13

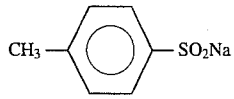

F-14

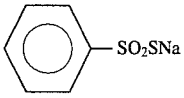

F-15

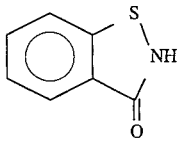

F-16

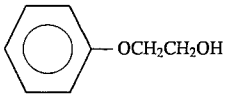

F-17

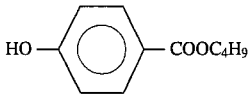

Samples 102 to 110 were made by changing the emulsion in the ninth layer (high-speed green-sensitive emulsion layer) from the emulsion A to the emulsions B to J.

After the samples 101 to 110 were subjected to a sensitometry exposure (1/100 second), they were processed by the following method.

(Processing method)

| Step | Time | Temperature |
|---|---|---|
| Color development | 3 min. 15 sec. | 38° C. |
| Bleaching | 6 min. 30 sec. | 38° C. |
| Washing | 2 min. 10 sec. | 24° C. |
| Fixing | 4 min. 20 sec. | 38° C. |
| Washing (1) | 1 min. 05 sec. | 24° C. |
| Washing (2) | 1 min. 00 sec. | 24° C. |
| Stabilization | 1 min. 05 sec. | 38° C. |
| Drying | 4 min. 20 sec. | 55° C. |

The compositions of the individual processing solutions are shown below.

| | (g) |
|---|---|
| (Color developing solution) | |
| Diethylenetriaminepentaacetate | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |

-continued

| | (g) |
|---|---|
| Water to make | 1.0 l |
| pH | 10.05 |
| (Bleaching solution) | |
| Ferric ammonium ethylenediaminetetraacetate trihydrate | 100.0 |
| Disodium ethylenediaminetetraacetate | 10.0 |
| Ammonium bromide | 140.0 |
| Ammonium nitrate | 30.0 |
| Ammonia water (27%) | 6.5 ml |
| Water to make | 1.0 l |
| pH | 6.0 |
| (Fixing solution) | |
| Disodium ethylenediaminetetraacetate | 0.5 |
| Sodium sulfite | 7.0 |
| Sodium bisulfite | 5.0 |
| Ammonium thiosulfate aqueous solution (70%) | 170.0 ml |
| Water to make | 1.0 l |
| pH | 6.7 |
| (Stabilizing solution) | |
| Formalin (37%) | 2.0 ml |
| Polyoxyethylene-p-monononylphenylether (average polymerization degree 10) | 0.3 |
| Disodium ethylenediaminetetraacetate | 0.05 |
| Water to make | 1.0 l |
| pH | 5.0–8.0 |

Sensitivity was defined by the reciprocal of an exposure amount by which a density of fog +1.0 was given on a characteristic curve of a magenta dye image and represented by a relative value assuming that the value of the sample 101 was 100. The values of sensitivity and fog are summarized in Table 4 below.

TABLE 4

| Sample No. | Emulsion name in 9th layer | Sensitivity | Fog | Remarks |
|---|---|---|---|---|
| 101 | A | 100 | 0.23 | Comparative example |
| 102 | B | 109 | 0.24 | Comparative example |
| 103 | C | 128 | 0.16 | Present invention |
| 104 | D | 129 | 0.19 | Present invention |
| 105 | E | 130 | 0.19 | Present invention |
| 106 | F | 135 | 0.18 | Present invention |
| 107 | G | 114 | 0.29 | Comparative example |
| 108 | H | 108 | 0.26 | Comparative example |
| 109 | I | 130 | 0.18 | Present invention |
| 110 | J | 129 | 0.18 | Present invention |

Table 4 shows that each sample according to the present invention had a high sensitivity and a low fog.

As has been described above, the silver halide photographic light-sensitive material of the present invention has startling effects on photographic sensitivity and fog.

What is claimed is:

1. A silver halide photographic light-sensitive material, comprising at least one silver halide emulsion layer formed on a support, wherein said emulsion layer contains a silver halide emulsion comprising tabular silver halide grains that substantially consist of silver bromoiodide, each having (100) faces as two parallel major faces, an aspect ratio of 2 or more, and an average silver iodide content of 2.5 mol % or more, that account for 50% or more of a total projected area of all silver halide grains contained in said emulsion, and wherein the mol % of silver iodide in the region from the surface of said tabular gain to a depth of about 10 Å is greater than the overall average silver iodide mol % of the entire grain.

2. The silver halide photographic light-sensitive material according to claim 1, wherein said tabular grains are subjected to gold sensitization and sulfur sensitization in the presence of cyanine dyes.

3. The silver halide photographic light-sensitive material according to claim 1, wherein said tabular grains are spectrally sensitized with cyanine dyes.

4. The silver halide photographic light-sensitive material according to claim 1, wherein said tabular grains are subjected to gold sensitization and sulfur sensitization in the presence of cyanine dyes.

5. The silver halide photographic light-sensitive material according to claim 1, wherein said silver halide emulsion layer contains at least 30%, based on the total amount of all emulsions in said layer, of said silver halide emulsion.

6. The silver halide photographic light-sensitive material according to claim 5, wherein said silver halide emulsion layer contains at least 50%, based on the total amount of all emulsions in said layer, of said silver halide emulsion.

7. The silver halide photographic light-sensitive material according to claim 6, wherein said silver halide emulsion layer contains at least 70%, based on the total amount of all emulsions in said layer, of said silver halide emulsion.

8. The silver halide photographic light-sensitive material according to claim 2, wherein said average silver iodide content of said tabular grains is 2.5 to 5 mol %.

9. The silver halide photographic light-sensitive material according to claim 2, wherein said aspect ratio of said tabular grains is in the range of 5 to 50.

10. The silver halide phonographic light-sensitive material according to claim 1, wherein the equivalent spherical diameter of said tabular grains is in the range of 0.2 to 3.0 μm.

11. The silver halide photographic light-sensitive material according to claim 10, wherein the variation coefficient of said equivalent spherical diameter of said tabular grains is 25% or less.

12. The silver halide photographic light-sensitive material according to claim 1, wherein said material comprises a blue-light sensitive layer, a green-light sensitive layer and a red-light sensitive layer on said support.

13. The silver halide photographic light-sensitive material according to claim 12, wherein said emulsion layer is green-light sensitive.

* * * * *